US005498374A

United States Patent [19]

Sabroske et al.

[11] Patent Number: 5,498,374

[45] Date of Patent: Mar. 12, 1996

[54] LASKIN NOZZLE PARTICLE GENERATOR

[75] Inventors: Kelly R. Sabroske, Kettering, Ohio; Donald A. Hoying, Brighton, Mass.; Douglas C. Rabe, Dayton, Ohio

[73] Assignee: The United States of America as represented by the Secretary of the Air Force, Washington, D.C.

[21] Appl. No.: 370,589

[22] Filed: Jan. 9, 1995

[51] Int. Cl.[6] ..... B01F 3/04

[52] U.S. Cl. ..... 261/77; 261/124

[58] Field of Search ..... 261/77, 124

[56] References Cited

U.S. PATENT DOCUMENTS

| | | | |
|---|---|---|---|
| 2,353,195 | 7/1944 | Sims | 261/77 |
| 2,402,132 | 6/1946 | Goldberg | 261/124 |
| 2,669,440 | 2/1954 | Lindenbergh | 261/124 |
| 2,883,169 | 4/1959 | Daman | 261/77 |
| 3,679,187 | 7/1972 | Smith | 261/124 |
| 3,756,580 | 9/1973 | Dunn | 261/124 |
| 4,421,696 | 12/1983 | Graue | 261/124 |
| 4,863,644 | 9/1989 | Harrington | 261/77 |

FOREIGN PATENT DOCUMENTS

| | | | |
|---|---|---|---|
| 302750 | 7/1968 | Sweden | 261/124 |
| 1379499 | 1/1975 | United Kingdom | 261/124 |

*Primary Examiner*—Tim R. Miles

*Attorney, Agent, or Firm*—Bobby D. Scearce; Thomas L. Kundert

[57] ABSTRACT

A particle generator system is described which comprises a substantially closed tank for containing liquid, a pressurized air source connected to the tank, a plurality of Laskin type nozzles operatively connected to the pressurized source and immersed in the liquid for generating particles of the liquid by passing pressurized air through the nozzles, an outlet on the tank for discharging the atomized particles and a source of dilution air for mixing with the discharged particle stream.

14 Claims, 6 Drawing Sheets

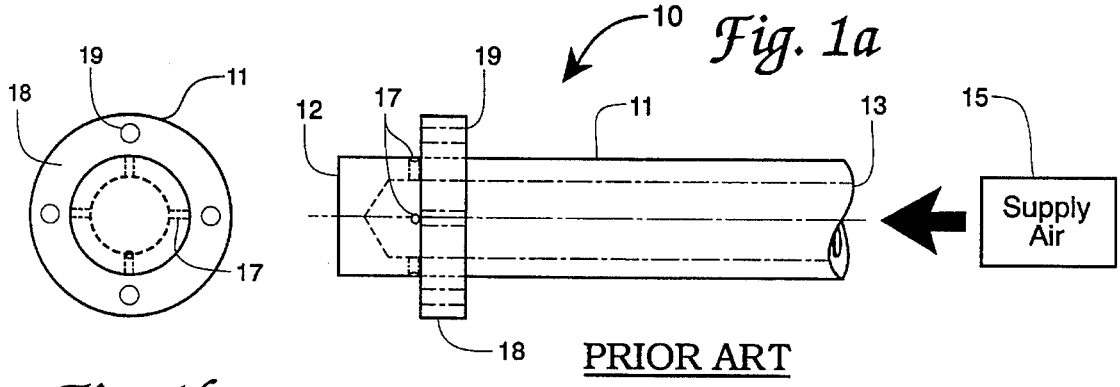
Fig. 1a
Fig. 1b
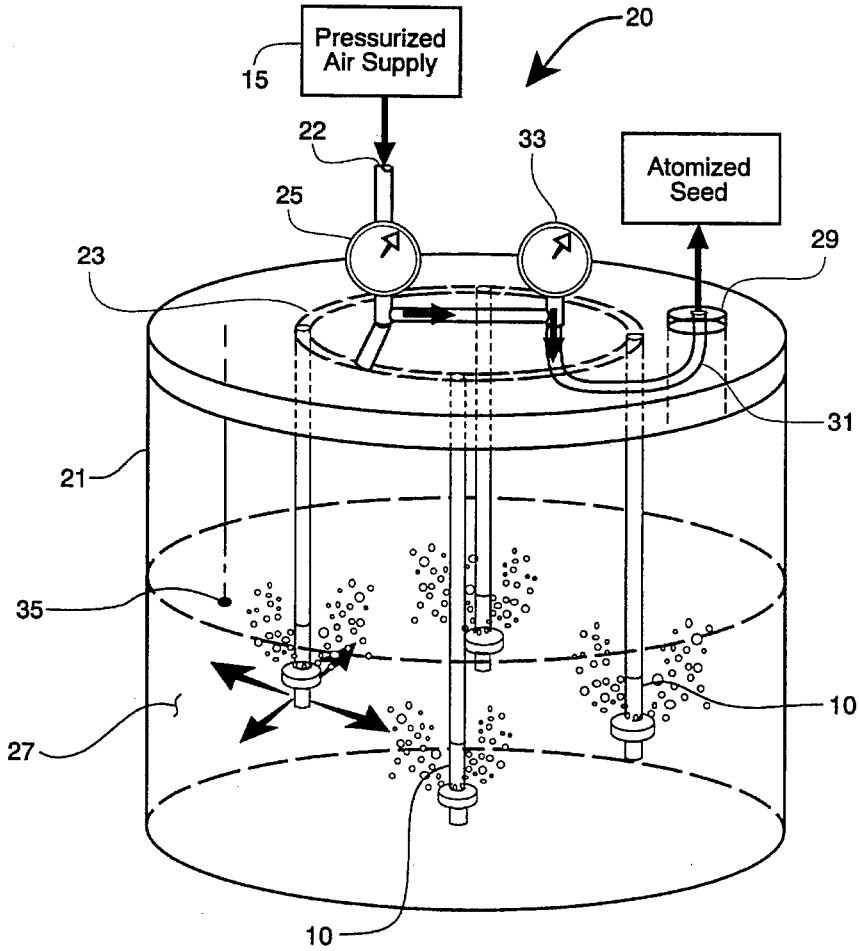
Fig. 2

LASKIN NOZZLE PARTICLE GENERATOR

RIGHTS OF THE GOVERNMENT

The invention described herein may be manufactured and used by or for the Government of the United States for all governmental purposes without the payment of any royalty.

BACKGROUND OF THE INVENTION

The present invention relates generally to particle generators, and more particularly to a particle generator system incorporating a plurality of Laskin type nozzles.

Numerous nonintrusive fluid flow measurement techniques rely on particle seeding the flow field. Laser Fringe Anemometry and Laser Transit Anemometry rely on particles passing through light and dark regions produced at the focal point of the anemometer system. Particle Image Velocimetry is a method by which a double pulsed laser sheet illuminates particles in a flow region; knowing the time between the two laser pulses allows numerous particles to be tracked, which results in a vector plot of the entire flow region in the plane of illumination. Doppler Global Velocimetry is a method for measuring the flow field in a plane of illumination, and relies on the Doppler frequency shift in the scattered laser light resulting from the movement of numerous particles in the illuminated plane of the flow field. In all of these methods, precision depends directly on the ability of the particles to accurately represent the fluid flow behavior.

Particles for flow measurement may be generated by various methods, including atomization, fluidization, sublimation and chemical reaction (including combustion). For compressor flow measurements, atomization techniques are most advantageous. Atomization with evaporation is a technique in which solid particles are mixed with a liquid carrier, and the slurry is atomized to provide solid particles to the flow once the liquid carrier evaporates. If the original solid particles in liquid suspension are a single size and do not coagulate in the atomization process, monodispersed particles are introduced into the flow field. Although monodispersed particles are obtained with a reasonable data rate, the liquid carrier often does not completely evaporate before entering the measurement location, resulting in a buildup of solid seed material on the test model and instrumentation. Evaporation also leads to local temperature variation in the flow field. Therefore, atomization with evaporation is considered unfavorable for certain applications, such as compressor research. A second atomization process comprises evaporation followed by recondensation and produces monodispersed particles in the flow field, but requires a more complex generating system than direct atomization. Direct atomization employs the liquid droplet as it is generated and is less complex than the other two atomization methods.

The invention solves, or substantially reduces in critical importance, problems with existing atomization methods by providing a direct atomization particle generating system for applications requiring controlled liquid droplet generation. The invention incorporates air dilution with submerged nozzles (commonly called Laskin or Laskey nozzles) utilizing a shearing process to create liquid droplets for injection into fluid flow. The droplets (seed particles) are useful for laser flow measurements. The embodiment of the invention disclosed in greatest detail utilizes four sheafing jets in each of four nozzles. Separate controls for nozzle pressure and air dilution pressure allows generation of a large range of particle sizes and concentrations. The system provides high data rates of pure liquid droplets which require no phase change or chemical reaction for flow measurement. Although the invention is most directly applicable to pure liquid atomization, it may be useful in other atomization techniques which require evaporation.

It is therefore a principal object of the invention to provide a particle generator.

It is a further object of the invention to provide a particle generation system incorporating a plurality of Laskin type nozzles.

These and other objects of the invention will become apparent as a detailed description of representative embodiments proceeds.

SUMMARY OF THE INVENTION

In accordance with the foregoing principles and objects of the invention, a particle generator system is described which comprises a substantially closed tank for containing liquid, a pressurized air source connected to the tank, a plurality of Laskin type nozzles operatively connected to the pressurized source and immersed in the liquid for generating particles of the liquid by passing pressurized air through the nozzles, an outlet on the tank for discharging the atomized particles and a source of dilution air for mixing with the discharged particle stream.

BRIEF DESCRIPTION OF THE DRAWINGS

The invention will be more clearly understood from the following detailed description of representative embodiments thereof read in conjunction with the accompanying drawings wherein:

FIGS. 1*a* and 1*b* are respective axial and end views of a typical prior art Laskin type nozzle of the kind incorporated into the particle generator system of the invention;

FIG. 2 is a schematic perspective drawing of a representative embodiment of the particle generator system of the invention including four nozzles of FIGS. 1*a* and 1*b;*

DETAILED DESCRIPTION

Figure 3:
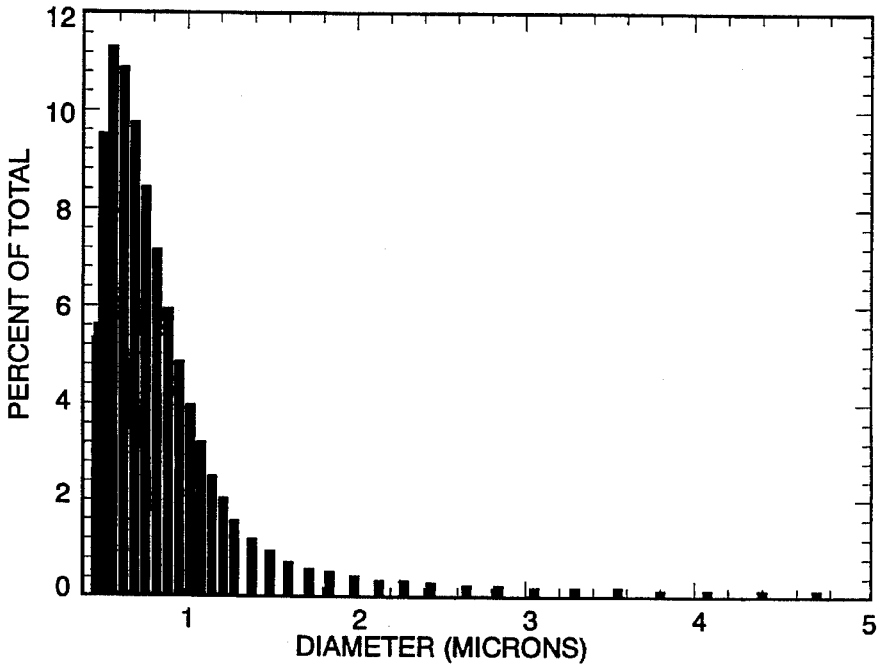
FIG. 3 shows percent of population of glycerin seed particles versus particle diameter for a sample output of the FIG. 2 system.

Referring now to the drawings, FIGS. 1*a* and 1*b* show respective axial and end views of typical prior art Laskin type nozzle 10 of the kind incorporated into the particle generating system of the invention. Although Laskin type nozzles may have many various sizes and configurations, the configuration selected for demonstration of the particle generator of the invention comprised a tubular member 11 closed at a first end 12 thereof and open at the second end 13 thereof for connection to source 15 of pressurized air. Member 11 may be of generally circular cross section as suggested in FIG. 1*b*, or oval or rectangular, as would occur to the skilled artisan practicing the invention. A plurality of radial holes 17 are defined in member 11 near first end 12 thereof and are regularly spaced around the periphery of member 11. Four (4) holes are provided in quadrature in member 11 of the nozzle configuration of FIGS. 1*a*, 1*b* selected for use in demonstration of the invention, although a greater or lesser number may be appropriate in certain applications as would occur to the skilled artisan guided by these teachings. Annular collar 18 of selected outer radial size is disposed around member 11 axially near radial holes 17. Collar 18 has a plurality of axial holes 19 therethrough, selected in number to equal the number of radial holes 17, and spaced regularly around collar 18 in positions immediately adjacent to, in line with and in pairing relationship with respective radial holes 17 in member 11. The axial holes and radial holes are disposed in paired relationship with the edge of each axial hole as close as practical to the exit plane of a corresponding radial hole so that an air jet produced at a radial hole by passage of pressurized air therethrough effectively draws liquid through the adjacent axial hole. Nozzle 10 included in the invention comprised a nominal 2½ inch section of ⅜ inch O.D. brass tubing having four 0.11 cm diameter radial holes 17 and four 0.21 cm diameter axial holes 19. Axial holes 19 in the demonstration unit were about 50% larger in diameter than radial holes 17 so that liquid would flow freely through holes 19. In the operation of nozzle 10, closed end 12 and collar 18 are submerged in a liquid to be atomizer. Pressurized air from source 15 is passed through member 11 and exits as small shearing air jets radially outwardly through holes 17. As the air jets from holes 17 cause liquid to be drawn as streams through axial holes 19, impact of the jets on the liquid streams breaks the liquid up into a fine mist of liquid droplets.

Referring now to FIG. 2, shown therein is a schematic perspective view of a representative particle generating system 20 of the invention including four nozzles 10 described above in relation to FIGS. 1*a*, 1*b*. It should be noted at the outset that other suitable plurality of nozzles may be used in a system of the invention as discussed in more detail below. System 20 comprises a suitably sized, substantially closed tank 21 having conduit means including inlet tube 22 interconnecting pressurized air source 15 and manifold 23 through pressure regulator 25. Four nozzles 10 are operatively connected to manifold 23 and communicate with source 15 therethrough. Air flow through nozzles 10 is controlled by regulator 25. Liquid 27 to be atomized in the operation of system 20 is disposed within tank 21 to a level at which nozzles 10 are submerged as suggested in FIG. 2. Outlet 29 (about one inch diameter) conducts atomized particles of liquid 25 generated within tank 21 in the operation of system 20 to a system (not shown) having need for the particles, such as for injection into a compressor inlet flow field for compressor laser flow measurement. An optional air dilution conduit line 31 operatively connected to pressurized air source 15 through pressure regulator 33 may be provided for inserting predetermined dilution air flow at outlet 29 for facilitating extraction and distribution of the atomized liquid 27 particles discharged from tank 21. Means for monitoring the temperature of liquid 27 may include thermocouple 35.

Size and concentration of particles generated in operation of system 20 were measured using an aerodynamic particle sizer (APS 33B, TSI, Inc., St. Paul Minn.) (not shown in the drawings). The APS uses a laser velocimeter to measure velocity of sample particles exiting an orifice over a preselected period of time (20 sec sampling time was selected for measurements herein; flow rate was held constant). Particle generation is therefore directly proportional to particle generation rate, and particle concentration will herein represent the particle generation rate. The difference between measured velocity and known air velocity represents a velocity lag related to the particle aerodynamic diameter (hereinafter referred to as particle diameter), which is defined as the physical diameter of a unit density (g/cc) sphere with the same settling velocity lag as the particle being measured.

An example APS output for a nozzle 10 pressure of 35 kPa and an air dilution pressure (at outlet 29) of 100 kPa for glycerin (b.p. 290° C., density 1.3 g/cc) at room temperature is shown in FIG. 3 as percent of population of seed particles versus particle diameter. For the FIG. 3 data, 86% of the particles are smaller than one micron. Particle concentration FIG. 3 is 3000 particles/cc. Most measured particles in the FIG. 3 data are 0.5 to 1.0 micron in diameter. It is noted that, although glycerine and two other liquids were used in demonstration of the invention, other liquids as would occur to one skilled in the art practicing the invention could be used.

System 20 was tested in demonstration of the invention at various nozzle and air dilution pressures and liquid temperatures. For optimum nozzle and air dilution pressure settings, liquid temperatures were varied from room temperature (about 20° C.) to 66° C.

Figure 4:
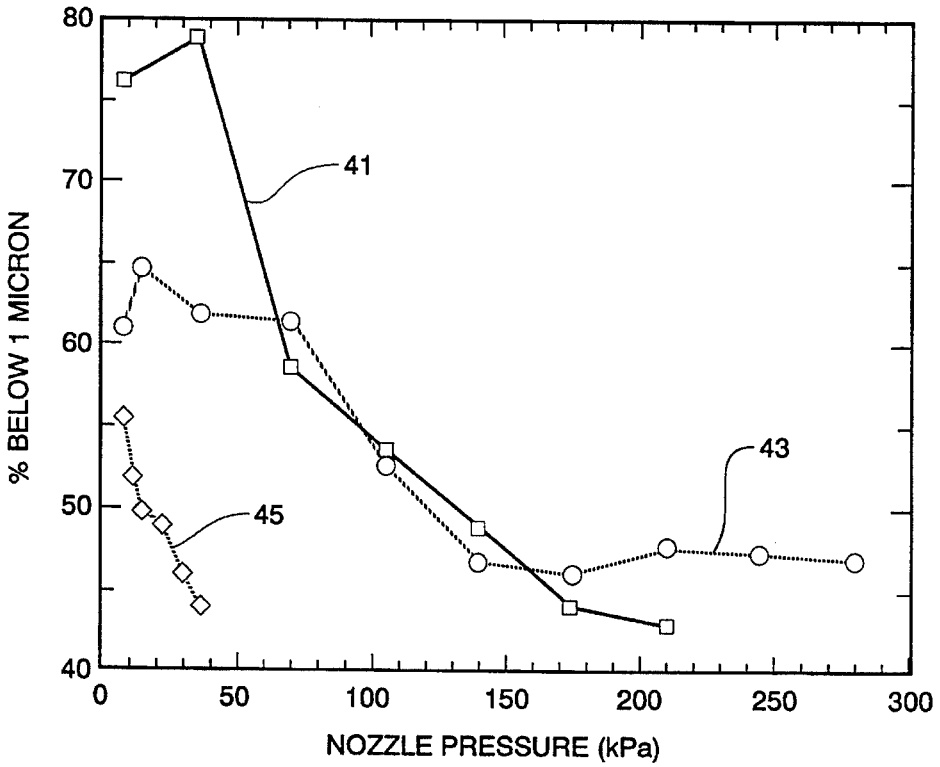
FIG. 4 shows particle size versus nozzle pressure for glycerine, propylene glycol and silicon oil in the FIG. 2 system.
Figure 5:
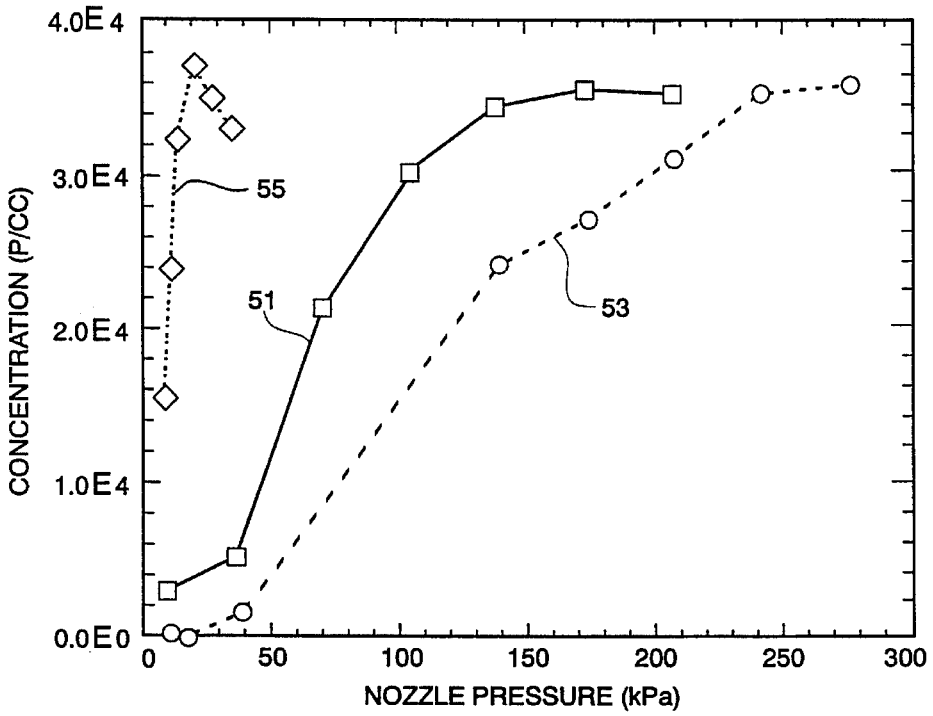
FIG. 5 shows particle concentration versus nozzle pressure for glycerine, propylene glycol and silicon oil in the FIG. 2 system.

FIGS. 4 and 5 compare particle size and concentration produced by system 20 as a function of nozzle 10 pressure for three seed materials, glycerine (plots 41,51), propylene glycol (b.p. 188° C., density 1.0 g/cc) (plots 43,53), and silicon oil (density 0.9 g/cc) (plots 45,55). All data were taken with the liquid at room temperature and dilution pressure at 70 kPa and show that glycerine generally yields the highest number of particles below one micron but requires the second highest nozzle pressure to reach maximum particle concentration. Silicon oil provides best particle concentration at low nozzle pressure but particle size is large compared to the other liquids. As nozzle pressure increases, air flow through system 20 increases. With no increase in particle generation, output concentration actually decreases, similar to silicon oil results of FIG. 4. The constant concentration shown for increased nozzle pressure in FIG. 4 for glycerine (plot 41) and propylene glycol (plot 43) indicates an increased particle generation rate that matches the increase in volumetric flow through the system.

FIGS. 4 and 5 show a general trend of increasing particle size with increasing nozzle pressure. For the selected nozzle configuration and number and size and number of holes 17,19 in the demonstration unit, it was seen that as nozzle pressure is increased, particle concentration increases for all liquids tested except silicon oil. For silicon oil, particle concentration was observed to first increase and then decrease at about 20 kPa as shown in FIG. 4. Nozzle pressures above 40 kPa were found to have no effect, which is considered a limitation, and nozzle pressures below 20 kPa must be maintained when using silicon oil. This is acceptable because the particle size produced with silicon oil is undesirably large at nozzle pressures above this value. For propylene glycol and glycerine, nozzle pressure should generally be maintained at or below 60 kPa to obtain acceptable particle size, but increased particle concentrations are possible with higher nozzle pressures.

Figure 6:
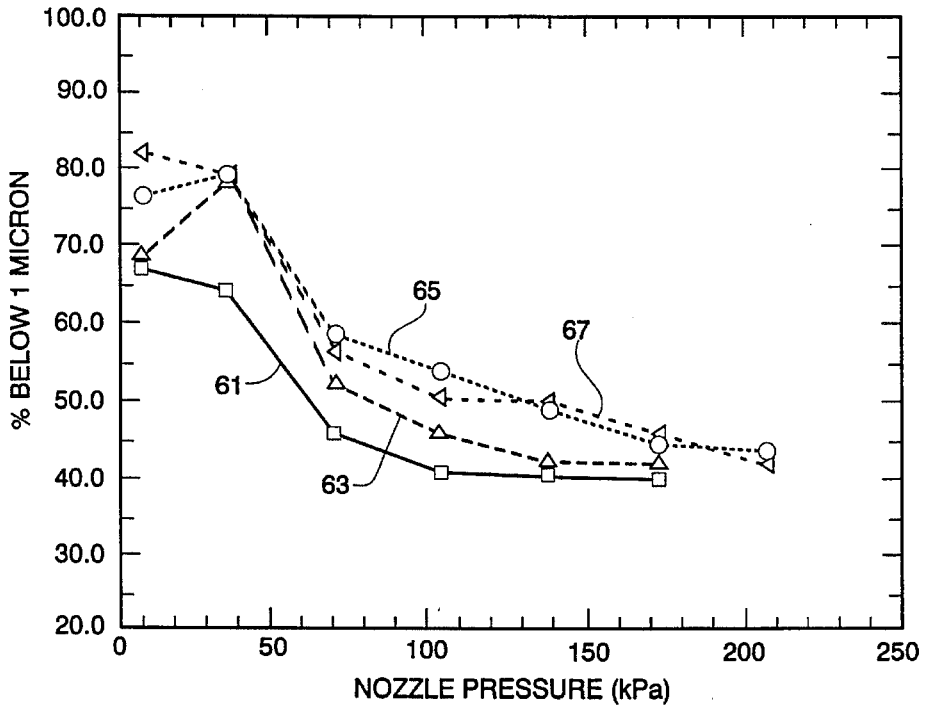
FIG. 6 shows particle size versus nozzle pressure for glycerine at various dilution pressures.
Figure 7:
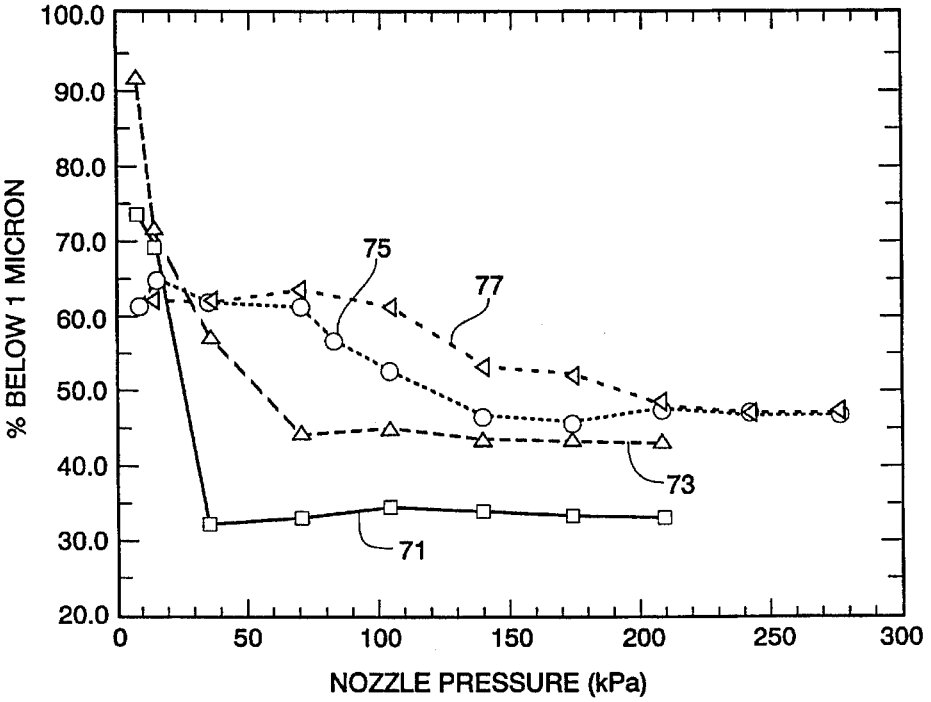
FIG. 7 shows particle size versus nozzle pressure for propylene glycol at various dilution pressures.
Figure 8:
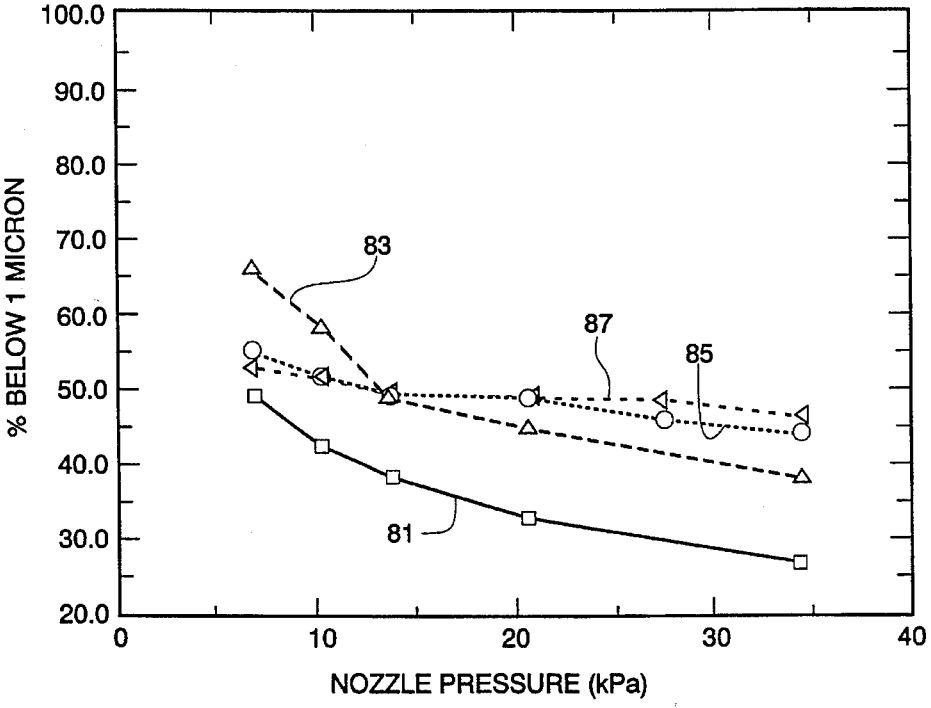
FIG. 8 shows particle size versus nozzle pressure for silicon oil at various dilution pressures.

FIGS. 6–8 show the effect of air dilution on system 20 performance for glycerine, propylene glycol and silicon oil, respectively, each at room temperature for air dilution pressures of 0 kPa (plots 61,71,81), 14 kPa (plots 63,73,83), 70 kPa (plots 65,75,85) and 140 kPa (plots 67,77,87). Increasing air dilution pressure for given nozzle pressure tends to increase the percentage of particles generated below one micron for all three liquids. FIGS. 6 and 8 show that for air dilution pressures above 70 kPa the rate of increase in submicron particles falls off. Little increase in number of submicron particles was obtained at higher air dilution pressures for glycerine (FIG. 6) and silicon oil (FIG. 8). This is not the case for propylene glycol (FIG. 7) using nozzle pressures in the range of 60 to 200 kPa. Additional increase in number of submicron particles was observed in this range by increasing air dilution pressure above 70 kPa. The results show that for maximum particle concentration and maximum number of particles below one micron, optimum nozzle pressures for glycerine, propylene glycol and silicon oil are about 35, 70, and 14 kPa and optimum air dilution pressures are about 100, 70 and 20 kPa for the nozzle configuration of the demonstration unit. Optimum values may differ for alternative nozzle configurations within the scope of these teachings and the appended claims.

Figure 9:
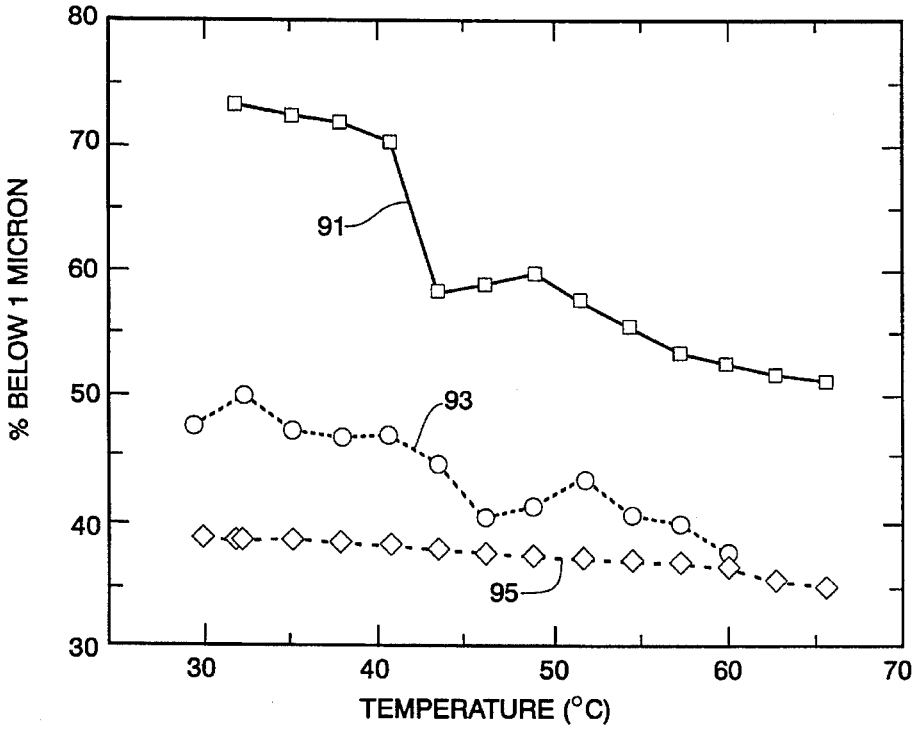
FIG. 9 shows particle size versus liquid temperature for glycerine, propylene glycol and silicon oil.
Figure 10:
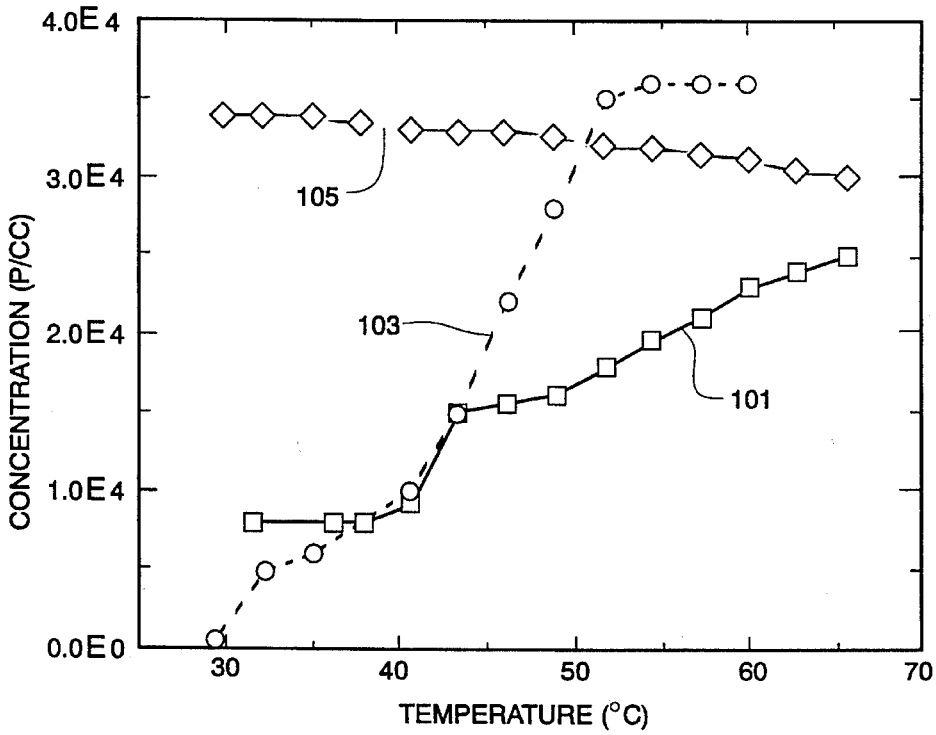
FIG. 10 shows particle concentration versus liquid temperature for glycerine, propylene glycol and silicon oil.

FIGS. 9 and 10 show the effect of temperature on particles produced at the optimum pressure settings. Silicon oil (plots 95,105) shows little response to change in liquid temperature but glycerine (plots 91,101) and propylene glycol (plots 93,103) show a trend toward increased particle size with increase of liquid temperature. Glycerine shows significant reduction in number of submicron particles at 43° C., but propylene glycol shows a steady decrease in submicron particles over the temperature range tested. However, FIG. 10 shows the concentration of particles to significantly increase with increased temperature for glycerine and propylene glycol. Liquid temperatures are preferably maintained near room temperature to maximize the number of submicron particles.

Figure 11:
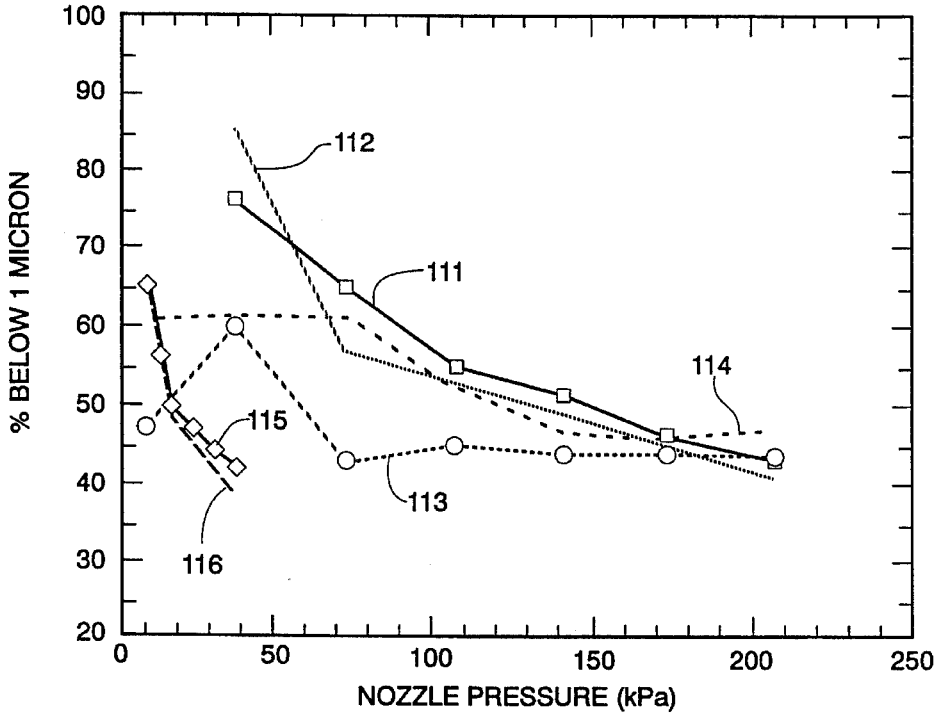
FIG. 11 shows particle size versus nozzle pressure for glycerine, propylene glycol and silicon oil.
Figure 12:
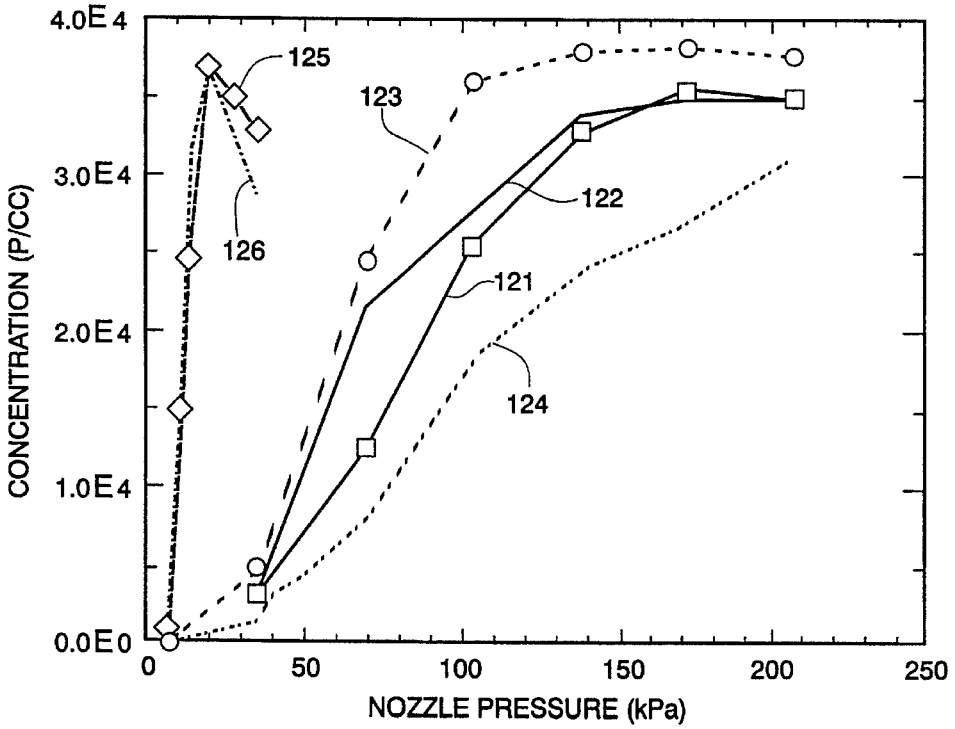
FIG. 12 shows particle concentration versus nozzle pressure for glycerine, propylene glycol and silicon oil.

The effect of including two or four nozzles on system 20 operation is shown in FIGS. 11 and 12 with respect to particle size and concentration. Data for two nozzles are shown for glycerine (111,121), propylene glycol (113,123) and silicon oil (115,125). Data for four nozzles are shown for glycerine (112,122), propylene glycol (114,124) and silicon oil (116,126). Little difference resulted using two or four nozzles with glycerine or silicon oil, but FIG. 12 shows that two nozzles are more effective in producing large concentrations of propylene glycol particles, although the higher concentration is compensated by a larger particle size as shown by FIG. 11. It is noted therefore that two, three or four (or more) nozzles may be selected by the skilled artisan in accordance with these teachings for use depending on the application and selected liquid.

The invention therefore provides a novel particle generator system incorporating a plurality of Laskin type nozzles for controllably and reproducibly producing particles of size and number to meet substantially any user requirements. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. A particle generating system, comprising:

(a) a substantially closed tank having an outlet, said tank configured for containing a liquid;

(b) a source of pressurized air;

(c) a plurality of nozzles for immersion into a liquid contained within said tank; and (d) wherein each of said nozzles comprises a tubular member closed at a first end thereof and operatively connected at a second end thereof to said source of pressurized air, a plurality of radial holes defined through and spaced around the wall of said tubular member near said first end thereof, and an annular collar on said tubular member near said first end thereof, said collar having a plurality of axial holes therethrough equal in number to said plurality of radial holes and disposed adjacent respective said radial holes in a paired relationship therewith, whereby an air jet is produced at each radial hole by passage of pressurized air therethrough and draws a stream of said liquid through the adjacent axial hole and atomizes said liquid by impact of said air jet on said stream thereby generating particles of said liquid for discharge through said outlet of said tank.

2. The system of claim 1 further comprising a liquid selected from the group consisting of glycerine, propylene glycol and silicon oil.

3. The system of claim 1 comprising two, three or four said nozzles.

4. The system of claim 3 further comprising a manifold operatively interconnecting said plurality of nozzles and said source of pressurized air.

5. The system of claim 4 further comprising means for controlling flow of pressurized air through said nozzles.

6. The system of claim 5 wherein said air pressure on said nozzles is less than about 60 kPa.

7. The system of claim 2 wherein said liquid is maintained at a temperature of about 20° to 66° C.

8. The system of claim 1 further comprising conduit means connected to said source of pressurized air for conducting a stream of pressurized air to said outlet.

9. A particle generating system, comprising:

(a) a substantially closed tank having an outlet, said tank configured for containing a liquid;

(b) a liquid disposed within said tank;

(c) a source of pressurized air;

(d) at least two nozzles for immersion into said liquid contained within said tank;

(e) conduit means and manifold means operatively interconnecting said nozzles and said source of pressurized air; and (f) wherein each of said nozzles comprises a tubular member closed at a first end thereof and operatively connected at a second end thereof to said conduit means, a plurality of radial holes defined through and spaced around the wall of said tubular member near said first end thereof, and an annular collar on said tubular member near said first end thereof, said collar having a plurality of axial holes therethrough equal in number to said plurality of radial holes and disposed adjacent respective said radial holes in a paired relationship therewith, whereby an air jet is produced at each radial hole by passage of pressurized air therethrough and draws a stream of said liquid through the adjacent axial hole and atomizes said liquid by impact of said air jet on said stream thereby generating particles of said liquid for discharge through said outlet of said tank.

10. The system of claim 9 wherein said liquid is selected from the group consisting of glycerine, propylene glycol and silicon oil.

11. The system of claim 9 comprising four said nozzles.

12. The system of claim 9 further comprising means for controlling flow of pressurized air through said nozzles.

13. The system of claim 12 wherein said air pressure on said nozzles is less than about 60 kPa.

14. The system of claim 9 wherein said liquid is maintained at a temperature of about 20° to 66° C.

* * * * *